US006435431B1

(12) United States Patent
Chapman, Jr. et al.

(10) Patent No.: US 6,435,431 B1
(45) Date of Patent: Aug. 20, 2002

(54) PULVERIZING SYSTEM PURGING

(75) Inventors: William Chapman, Jr., South Yarmouth; Anthony Schepis, Hanover, both of MA (US)

(73) Assignee: Sturtevant, Inc., Hanover, MA (US)

( * ) Notice: Subject to any disclaimer, the term of this patent is extended or adjusted under 35 U.S.C. 154(b) by 0 days.

(21) Appl. No.: 09/567,281

(22) Filed: May 8, 2000

Related U.S. Application Data

(60) Provisional application No. 60/171,047, filed on Dec. 16, 1999.

(51) Int. Cl.[7] ..... B02C 19/00

(52) U.S. Cl. ..... 241/19; 241/24.1; 241/30

(58) Field of Search ..... 241/79.1, 24.1, 241/19, 82, 186.3, 33, 80, 97, 30

(56) References Cited

U.S. PATENT DOCUMENTS 3,326,475 A * 6/1967 Lykken et al.
4,361,290 A * 11/1982 Francis
5,553,792 A * 9/1996 Romer et al.

OTHER PUBLICATIONS

NEA Impact Mill, Classifier Mill ICM, Henschel Mixers America Inc. Brochure (1997).
Mikro–ACM Pulverizers MikrolPol Brochure, (12/88).
Air Purge Classifier Mill, Blue Tech, Inc. (undated).

* cited by examiner

*Primary Examiner*—Mark Rosenbaum
(74) *Attorney, Agent, or Firm*—Fish & Richardson, P.C.

(57) ABSTRACT

A powderizing assembly includes a product line for receiving product sized powderized material from a powderizing mill, and a purger assembly for receiving non-product sized material from the mill. Non-product sized material is periodically removed from the mill and fed to the purger. The purger assembly includes a purge line in parallel with the product line for receiving material from the mill. The purge line includes a cyclone separator and a filter. A first valve is operable to direct material from the mill to one of the product line or the purge line. The first valve and a second valve are operable to isolate the product line from the purge line. A method of purging a powderizing mill includes providing a purger assembly in communication with the powderizing mill, diverting flow from a product line in communication with the powderizing mill to the purger assembly, and interrupting a size classifier of the powderizing mill to allow non-product sized material from the powderizing mill to be fed to the purger assembly.

10 Claims, 3 Drawing Sheets

PULVERIZING SYSTEM PURGING

This application claims priority from provisional application No. 60/171,047, filed Dec. 16, 1999.

BACKGROUND

The invention relates to apparatus and method for purging a pulverizing system of contaminant residue.

An impact mill pulverizes material into fine powders in the range of about 45 microns or less in size. An integral classifier is used to reject oversize particles for the purpose of re-introducing oversized material to the grinding chamber for further processing.

Referring to FIG. 1, a prior art impact mill powderizer and classifier 10 includes a high speed rotor disk 12 with impactors 14, e.g., pins, for pulverizing material, and a rotatably driven classifying wheel 16 for rejecting oversize particles.

In use, material is introduced to powderizer/classifier 10 through a feed inlet tube 18. The material is pulverized by rotating impactors 14. The pulverized product is then swept upward in a column of air and exposed to classifying wheel 16. Fine particles are pulled through the rotating classifier 16 by air flow created by an exhaust fan 20. Oversize particles rejected by classifier 16 are returned into the path of impactors 14 by zone divider 22 for additional size reduction. Particle size is adjusted by increasing or decreasing the rotational speed of classifier 16.

Referring to FIG. 2, the fine product particles are drawn into a product collector 32 where the fine product particles are separated from the air flow.

SUMMARY

A powderizing assembly includes a mill for pulverizing material, a main product line, and a purge line including a cyclone separator. Periodically the mill is cleared of all material which is sent through the purge line with residual solids being removed by the cyclone separator.

According to one aspect of the invention, a powderizing assembly includes a product line for receiving product sized powderized material from a powderizing mill, and a purger assembly for receiving non-product sized material from the mill. Non-product sized material is periodically removed from the mill and fed to the purger assembly.

Embodiments of this aspect of the invention may include one or more of the following features.

The purger assembly includes a purge line in parallel with the product line for receiving material from the mill. A first valve is operable to direct material from the mill to one of the product line or the purge line. The first valve and a second valve are operable to isolate the product line from the purge line. The purger assembly includes a cyclone separator and a filter. Alternatively, the purger assembly includes a filter/collector and a fan downstream of the filter/collector.

The powderizing assembly includes the powderizing mill for powderizing the material, a filter/collector downstream of the product line and the purger assembly, and a fan downstream of the product line and the purger assembly.

According to another aspect of the invention, a purger assembly includes a purge line configured to be placed in communication with a powderizing mill for removing residue material from the mill. The purge line includes a cyclone separator.

Embodiments of this aspect of the invention may include one or more of the following features.

The purge line includes a filter. The purge line includes a first valve operable to direct material from the mill to the purge line. The purger assembly includes a filter/collector downstream of the cyclone separator, and a fan downstream of the cyclone separator.

According to another aspect of the invention, a purger assembly includes a purge line configured to be placed in communication with a powderizing mill for removing residue material from the mill. The purge line including a filter/collector.

Embodiments of this aspect of the invention may include one or more of the following features.

The purge line includes a valve operable to direct material from the mill to the purge line, and a fan downstream of the filter/collector.

According to another aspect of the invention, a method of purging a powderizing mill includes providing a purger assembly in communication with the powderizing mill, diverting flow from a product line in communication with the powderizing mill to the purger assembly, and interrupting a size classifier of the powderizing mill to allow non-product sized material from the powderizing mill to be fed to the purger assembly.

Embodiments of this aspect of the invention may include one or more of the following features.

The size classifier is periodically interrupted. The size classifier is interrupted based on amperage draw.

The removal of residue from the mill advantageously lessons wear on the mill, and removes a potential source of contamination from the end product, i.e., the residue contains contaminants that can wind up in the end product. By periodically exhausting the offspecification material that is harder to grind, the quality of the end product is beneficiated and the useful life of the machinery is extended.

Other features and advantages of the invention will be apparent from the following detailed description, and from the claims.

DETAILED DESCRIPTION

Figure 1:
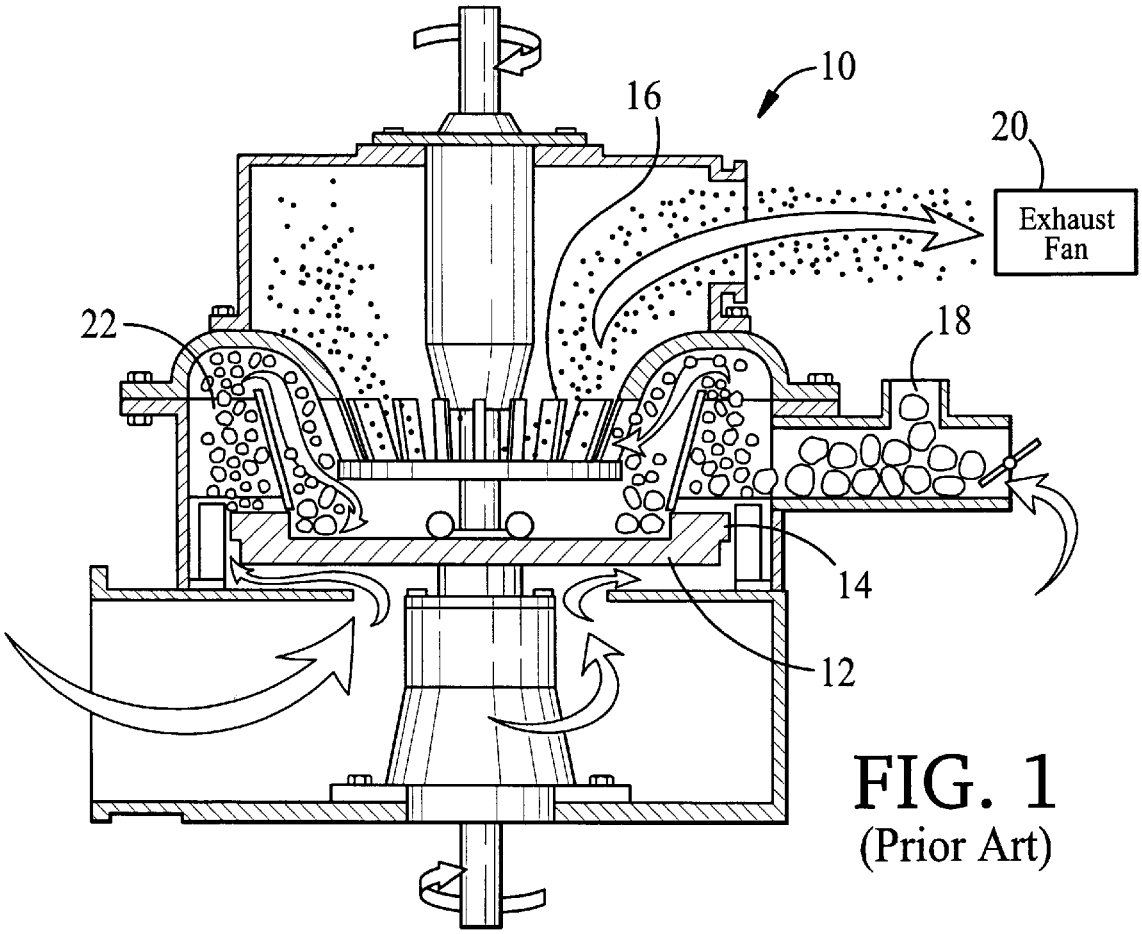
FIG. 1 (Prior Art)
FIG. 1 shows a prior art powderizer/classifier mill.
Figure 2:
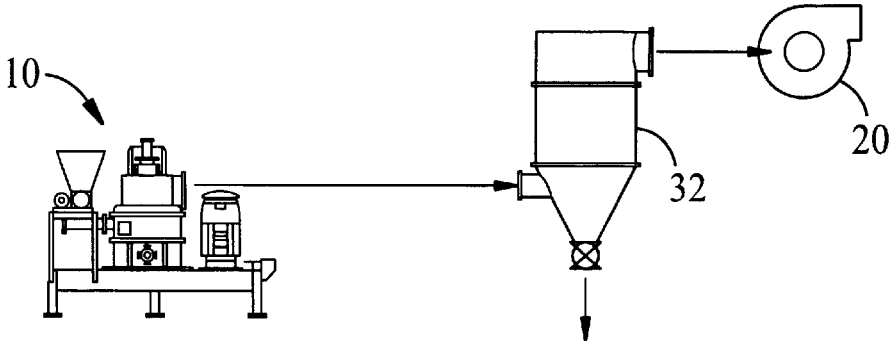
FIG. 2 (Prior Art)
FIG. 2 shows additional system components of the prior art powderizer/classifier mill of FIG. 1.
Figure 3:
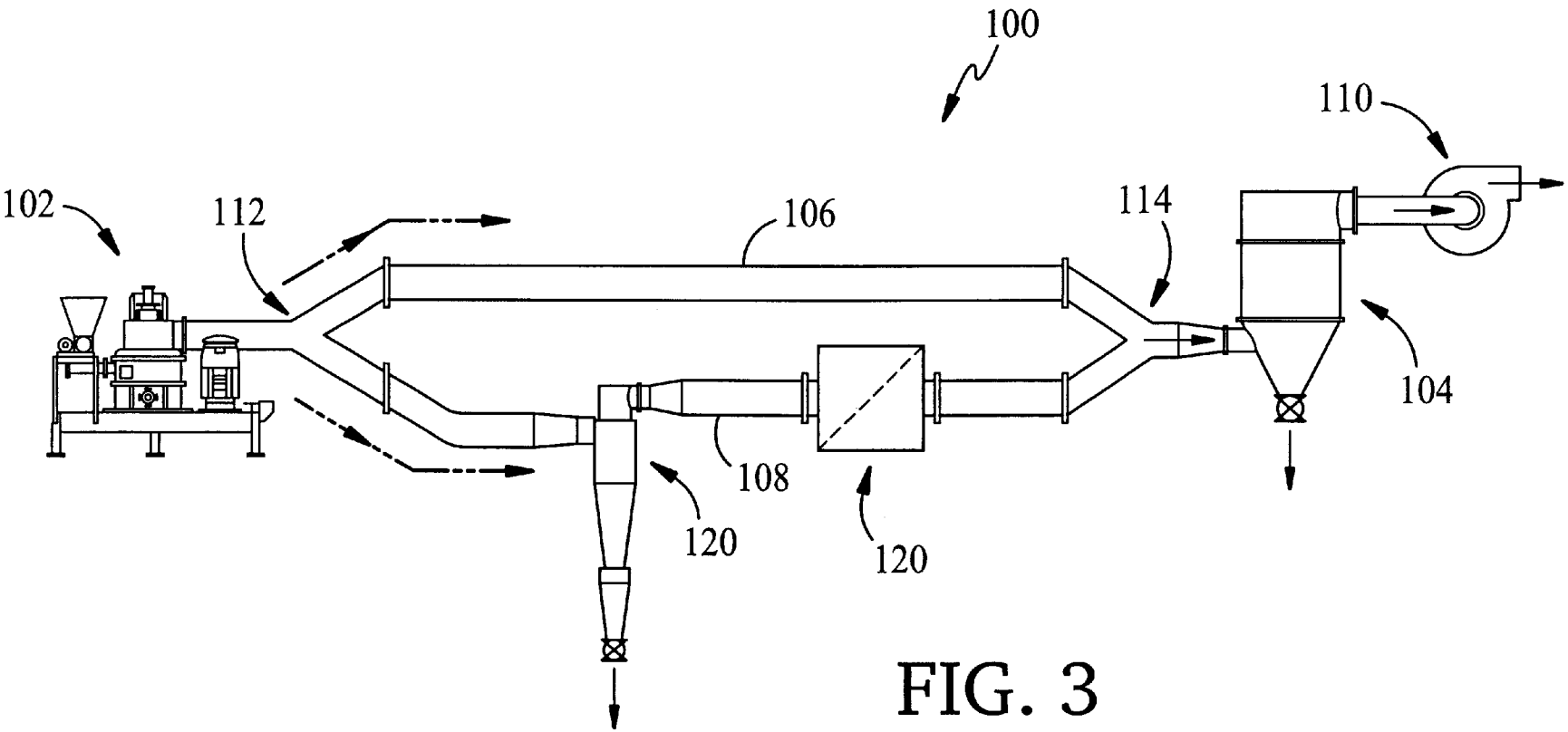
FIG. 3 shows a purge path according to the invention incorporated into a powderizer/classifier.

To remove residue material which can build up on the inside of the powderizer/classifier, a purge cycle is added to the operating process. Referring to FIG. 3, a powderizing assembly 100 includes a powderizer/classifier combination 102, as described above with reference to FIG. 1, a filter/collector 104 including a dust collector, as described above with reference to FIG. 2, a main product flow line 106 connecting powderizer/classifier 102 to filter/collector 104, and a by-pass purge flow line 108 in parallel with product flow line 106, which also connects powderizer/classifier 102 to filter/collector 104. Assembly 10 also includes a fan 110 for drawing material through powderizer/classifier 102 to filter/collector 104.

Located in the flow path between powderizer/classifier 102 and filter/collector 104 are first and second diverter valves 112, 114 for channeling the flow of material through either product flow line 106 or purge flow line 108. Valves 112, 114 isolate product flow line 106 from purge flow line 108. During normal operation, material flows through product flow line 106. Periodically, to remove residue material from powderizer/classifier 102, valves 112, 114 are actuated such that material flows through purge line 108. Purge line 108 includes a cyclone separator 120 and filter 122 which remove residue and oversize particles. The remaining air flows to filter/collector 104.

To initiate a purge cycle, product flow to powderizer/classifier 102 is stopped; diverter valves 112, 114 are simultaneously activated to change the flow path from product flow line 106 to purge line 108; the classifier motor is shut down allowing the classifier to free-wheel such that the residual solids can pass through the classifier; fan 110 is adjusted to full air flow; and residual solids are drawn through cyclone 120 where the residual solids drop out through the bottom of cyclone 120 while air flow is still directed to filter/collector 104.

Flow through purge line 108 is of short duration, e.g., less than one minute, to minimize the interruption of normal operation. Normal operation is resumed by restarting the classifier motor, actuating diverter valves 112, 114, and introducing feed to powderizer/classifier 102. A purge cycle can be run periodically whenever the main motor amperage exceeds normal operating parameters, e.g., every 30–120 minutes, to remove residue from powderizer/classifier 102.

For example, when grinding kaolin with the Sturtevant Powderizer, the contaminant, which is, e.g., mullite, and is normally found in the pre-ground kaolin, is rejected by the classifier because it is harder to grind to the product size. The contaminant deleteriously accumulates and recycles inside the mill chamber eventually affecting the performance of the mill, as shown by an increase in the amperage draw of the rotor motor. After a one-minute purge, the contaminant is essentially completely removed from the grinding chamber.

With this system, the mill system is capable of producing a product fineness containing less than 0.0023 grams of residue of +325 mesh from a 100 gram sample.

Other embodiments are within the scope of the following claims.

Figure 4:
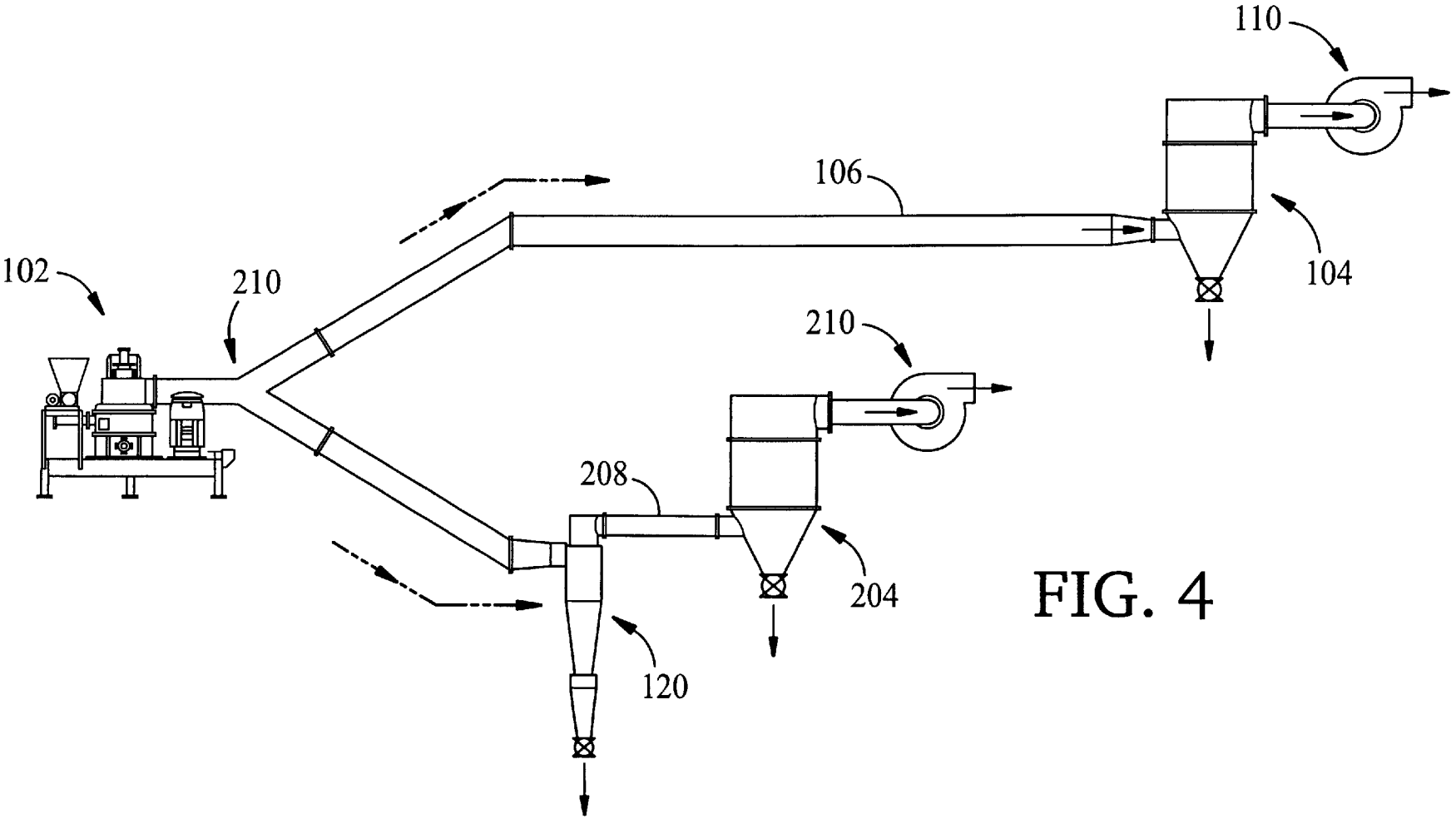
FIG. 4 shows an additional embodiment of a purge path incorporated into a powderizer/classifier.

For example, referring to FIG. 4, rather than connecting the by-pass purge flow line to filter/collector 104, a powderizing assembly 200 includes a by-pass purge flow line 208 in parallel with product flow line 106, which has a separate filter/collector 204 and a fan 210 downstream of filter/collector 204. Cyclone 120 is optional since filter/collector 204 is capable of handling the full load of the contaminant.

To initiate a purge cycle, product flow to powderizer/classifier 102 is stopped; diverter valve 112 is activated to change the flow path from product flow line 106 to purge line 208; the classifier motor is shut down allowing the classifier to free-wheel such that the residual solids can pass through the classifier; fan 210 is adjusted to full air flow; and residual solids are drawn through filter/collector 204.

What is claimed is:

1. A method of purging a powderizing mill, comprising:

providing a purger assembly in communication with the powderizing mill, diverting flow from a product line in communication with the powderizing mill to the purger assembly, and interrupting a size classifier of the powderizing mill to allow non-product sized material from the powderizing mill to be fed to the purger assembly.

2. The method of claim 1 wherein the size classifier is periodically interrupted.

3. The method of claim 1 wherein the size classifier is interrupted based on amperage draw.

4. The method of claim 1 further comprising stopping a product flow to the powderizing mill.

5. The method of claim 3 wherein diverting flow to the purger assembly comprises activating a diverter for periodically changing the flow path from the product line to the purger assembly.

6. The method of claim 5 wherein the diverter comprises a valve.

7. The method of claim 6 wherein the diverter comprises two valves activated simultaneously.

8. The method of claim 1 further comprising separating residue and oversize particles from a feed to the purger assembly.

9. The method of claim 8 wherein separating residue and oversize particles is performed using a cyclone separator.

10. The method of claim 1 further comprising resuming normal operation after non-product sized material from the powderizing mill is fed to the purger assembly.

* * * * *